United States Patent [19]

Anderson et al.

[11] 4,201,657

[45] May 6, 1980

[54] COAL SPRAY COMPOSITION

[75] Inventors: Ardis L. Anderson, Ponca City, Okla.; Marvin E. Huyser, Houston, Tex.

[73] Assignee: Conoco, Inc., Ponca City, Okla.

[21] Appl. No.: 953,392

[22] Filed: Oct. 23, 1978

[51] Int. Cl.[2] ..... C08L 95/00

[52] U.S. Cl. ..... 208/23; 44/6

[58] Field of Search ..... 208/23; 44/6

[56] References Cited

U.S. PATENT DOCUMENTS

| | | | |
|---|---|---|---|
| 3,462,359 | 8/1969 | Fauber | 208/23 |
| 3,476,679 | 11/1969 | Fauber | 208/23 |

*Primary Examiner*—Herbert Levine

*Attorney, Agent, or Firm*—Richard W. Collins

[57] ABSTRACT

A composition for treating particulate hydrocarbon fuel material such as coal and lignite to reduce dust losses, improve cold weather handling and reduce spontaneous combustion. The composition is a blend of aromatic hydrocarbon oil and asphalt and has a high viscosity, high flash point and high initial boiling point.

6 Claims, No Drawings

COAL SPRAY COMPOSITION

BACKGROUND OF THE INVENTION

This invention relates to the treatment of particulate hydrocarbon fuel such as coal and lignite to reduce dust losses during transportation and storage, to improve cold weather handling properties, and to reduce the incidence of spontaneous combustion. More particularly, the invention relates to a novel composition for spray treatment of particulate hydrocarbon fuel.

Various oils and other materials have in the past been applied to particulate hydrocarbon fuel for the purpose of controlling dust losses. U.S. Pat. Nos. 2,005,512; 2,319,942 and 2,383,543 all describe compositions for spraying coal and the like to control dusting. The normal practice is to use a relatively light oil for this purpose. However, the use of light oil leads to problems such as vaporization, run-off and washing out. U.S. Pat. No. 2,005,512 suggests the use of a hot highly viscous oil to overcome these problems. U.S. Pat. Nos. 2,319,942 and 2,383,543 suggest the use of particular solvent extracts as coal spray oil constituents. Each of the compositions suggested in the above-discussed patents is primarily intended to control dust losses during transportation and storage of the fuel particles.

In the handling and storage of lignite, it is desirable to reduce the normal moisture content of the lignite, which typically is from 25 to 40 percent, in order to reduce transportation costs and to improve the heating efficiency of the material. However, when lignite is dried to a moisture content below 10 to 15 percent, there is a tendency for the material to re-absorb moisture. Further, when lignite is dried to that extent, it becomes unstable and very susceptible to spontaneous ignition during storage. U.S. Pat. No. 2,610,115 describes a process for drying raw lignite followed by mixing the material with a mineral hydrocarbon. The mixture of lignite and mineral hydrocarbon is then heated to further reduce the moisture content and to improve its storage characteristics. More recently, U.S. Pat. No. 3,985,517 describes a process for drying and passivating lignite by treatment with a residual hydrocarbon material.

While the prior art approaches described in the above-discussed references have been successful to varying degrees, there has been a continuing need for an improved composition which, when sprayed on particulate hydrocarbon fuel, will reduce dust losses and spontaneous combustion of the fuel without causing problems from vaporization, runoff or wash-off of the treating composition.

SUMMARY OF THE INVENTION

According to the present invention, a composition is provided which, when sprayed on particulate coal, lignite or the like, will greatly reduce dust losses during transportation and storage. The composition is also effective in improving cold weather handling properties and in reducing spontaneous ignition of the fuel. Further, the composition is effective in small amounts, and is not subject to the disadvantages encountered in prior art compositions used for this purpose. The composition of this invention comprises a blend of a highly aromatic hydrocarbon oil and an asphalt material. The composition has a high vescosity, a high flash point, and a high initial boiling point.

It is accordingly an object of the present invention to provide a composition for treating solid fuel such as crushed coal and lignite to improve the storage and handling characteristics of the fuel, and to accomplish this without causing problems from vaporization of the treating material and runoff or wash-out of the treating material.

DESCRIPTION OF THE PREFERRED EMBODIMENT

The composition according to this invention is a blend of an aromatic hydrocarbon oil and an asphalt material. The aromatic hydrocarbon oil comprises from 50 to 75 volume percent of the treating composition. The balance of the composition is an asphalt material such as a 100 penetration asphalt obtained during conventional petroleum refining.

The composition has several critical properties. One of these properties is an initial boiling point above 500° F. This high initial boiling point effectively eliminates the problem of vaporization of the material during and after application to the coal or lignite being treated. Preferably, the initial boiling point of the composition is about 550° F.

Another critical property of the composition is a viscosity of at least 700 centistokes at 100° F. The use of such a high viscosity material requires that it be heated prior to being applied to the material to be treated, but the high viscosity effectively eliminates the problem of runoff of the composition from the treated material. Preferably, the composition has a viscosity of about 1500 centistokes. the viscosity of the composition is much higher than even the so-called highly viscous oil described in U.S. Pat. No. 2,005,512. That patent suggests a Saybolt viscosity of from 100 to 1200 at 100° F., which is equivalent to 20.5 to 260 centistokes. The much higher viscosity of the composition of this invention is particularly important in eliminating runoff.

Another critical property of the composition of this invention is a high flash point. A flash point of at least 230° F., and preferably about 275° F. or higher is required.

The asphalt component of the composition can be a typical petroleum refinery asphalt product such as and 85–100 penetration asphalt.

The aromatic hydrocarbon component of the composition is desirably a petroleum refinery stream such as decant oil from a fluidized bed catalytic cracking operation, although it may be from any source so long as it has the necessary degree of aromaticity and will provide a blended composition having the required properties of viscosity, flashpoint and initial boiling point. A typical decant oil has a K factor of about 10.1. The K factor is a well-known characterization index indicating the degree of aromaticity of hydrocarbon oil and is obtained by dividing the cube root of the average boiling point of the oil in degrees Rankine by the specific gravity of the oil at 60° F. The aromatic hydrocarbon oils usable in the composition of this invention must have a K factor no higher than 10.5 in order to provide the necessary properties to the composition. The aromatic components tend to partially dissolve the surface of the fuel particles to form a protective coating.

The composition of the invention, in addition to reducing the tendency of the treated material to spontaneously ignite and reducing dust losses, provides improved handling characteristics in subfreezing weather. When applied to dried lignite, the composition provides for lower transportation costs, lessened storage handling problems and better boiler efficiencies. Coal and lignite particles which have been treated with the composition of this invention are dry to the touch, and the composition will not run off even when subjected to water.

An example of a particularly preferred embodiment of the composition of this invention is a blend of 67 percent by volume clarified decant oil from a fluidized bed catalytic cracking unit and 33 percent by volume of a 100 penetration asphalt. The decant oil has a K factor of 10.1. The blended product has the properties listed in the following table.

TABLE I

| | |
|---|---|
| Viscosity, cSt @ 100° F. | 1500 |
| Gravity, °API | 5 |
| Flash, PM, °F. | 275 |
| Pour Point, °F. | 40 |
| Initial Boiling Point, °F. | 550 |

While aromatic hydrocarbon oils having a K factor of up to 10.5 are satisfactory, a preferred K factor is from 10.0 to 10.2.

The composition of this invention is preferably used in an amount of from 0.5 to 3.0 gallons per ton of material being treated. The particular amount depends on the particle size of the material as well as the dust-forming tendency and other properties of the material. Studies have indicated that, when coal or lignite is transported a significant distance by open railcars, losses of from 1 to 3 percent will be incurred. This represents an economic loss and contributes to air pollution. Treatment with the composition of this invention at the proper level reduces this loss by about 75 percent .

This composition has the ability to agglomerate particles due to the solvent action of the aromatic component on the particles, and the asphalt action then cures on the agglomerated particles, minimizing disintegration during transportation and storage. Tests have also shown that the surface area of untreated coal is much higher than the surface area of coal treated with the composition of this invention.

Handling and unloading of coal in subfreezing weather is greatly facilitated by the use of this composition. The composition, upon contact with the coal, cures quickly and forms a hard, dry coating which acts to prevent the coal from sweating, thereby preventing the inherent moisture from freezing coal particles together. Also, it repels water from the coal particles, reducing moisture absorption, which also reduces freezing problems.

The hazards of spontaneous combustion are greatly reduced by this composition. There are two basic theories with respect to spontaneous combustion. The first theory is that oxidation of the hydrocarbons begins with some increase in temperature and that this reaction continues until a temperature is reached that initiates a fire. This theory may best describe spontaneous combustion of low ash coals. The other theory is that the moisture in the air reacts with ash components, particularly iron sulfide, to form sulfates and sulfuric acid. The sulfuric acid then reacts exothermically with coal particles and combustion temperature is achieved. This theory probably applies for high ash coals. Treating with the composition of this invention coats the particles, effectively covering the mineral components, and greatly reduces the surface area, thus eliminating the propensity to spontaneously ignite.

The composition generally will require heating in order to make it sprayable. Due to its high initial boiling point, the composition does not vaporize significantly even when heated to 250° to 300° F. or higher. Usually, heating to 200° to 225° F. is sufficient.

A composition comprising 67 percent decant oil having a K factor of 10.1 and 33 percent of 100 penetration asphalt having the properties set forth in Table 1 was heated and sprayed on crushed coal at a rate of 1.5 gallons per ton. The composition dried soon after application and the treated coal was dry to touch. The treated coal was placed on a plastic mat, and was sprinkled frequently with water. After one month, the mat showed no trace of oil, indicating that the composition did not wash out from the treated coal. The treated coal showed no indication that it would adversely affect conveyer belt material.

The preferred composition as described above was compared with No. 6 fuel oil as a coal treating material. No. 6 fuel oil is the most widely used substance currently in commercial use for coal treatment. As expected, the composition of this invention showed a much lower weight loss when compared to the fuel oil treated coal as determined by weight loss over a one week period at a series of temperatures. The composition of the invention consistently showed a weight loss of less than one fourth that of the fuel oil treated composition.

The critical factors in obtaining a satisfactory oil treating composition in accordance with the invention are the provision of an adequate amount of sufficiently aromatic hydrocarbon material to provide a solvent action to the solid particles being treated, and the provision of sufficient asphalt to fuse and cure the coating. Additionally, the composition must have a sufficiently high initial boiling point to keep hydrocarbon emissions to a minimum, a sufficiently high flash point to provide safe operation, and a sufficiently high viscosity to prevent runoff and washout. All of these properties are provided by the composition of this invention.

We claim:

1. A hydrocarbon composition comprising:
   (a) 50 to 75 volume percent decant oil from a fluidized bed catalytic cracking operation, said decant oil having a K factor of not more than 10.5; and
   (b) 50 to 25 volume percent asphalt; said composition having an initial boiling point above 500° F., a viscosity of at least 700 centistokes at 100° F., and a flash point of at least 230° F.

2. The composition of claim 1 wherein the decant oil comprises 67 volume percent thereof with the balance being asphalt.

3. The composition of claim 1 wherein the initial boiling point thereof is about 550° F.

4. The composition of claim 1 wherein the flash point thereof is about 275° F.

5. The composition of claim 1 wherein the viscosity thereof is about 1500 centistokes at 100° F.

6. The composition of claim 1 wherein the viscosity thereof is about 1500 centistokes at 100° F., the flash point is about 275° F., and the K factor is from 10.0 to 10.2.

* * * * *